US006158076A

United States Patent [19]

Rutkowski et al.

[11] Patent Number: 6,158,076

[45] Date of Patent: Dec. 12, 2000

[54] FEED CONTROL DEVICES FOR HAND OPERATED DRAIN CLEANING TOOLS

[75] Inventors: Michael J. Rutkowski, Brunswick; Larry F. Babb, Grafton; Jon R. Dunkin, Elyria, all of Ohio

[73] Assignee: Emerson Electric Co., St. Louis, Mo.

[21] Appl. No.: 09/253,923

[22] Filed: Feb. 22, 1999

[51] Int. Cl.[7] ..... B08B 9/02

[52] U.S. Cl. ..... 15/104.33; 15/104.31

[58] Field of Search ..... 15/104.33, 104.31, 15/104.05

[56] References Cited

U.S. PATENT DOCUMENTS

| | | | |
|---|---|---|---|
| 2,245,823 | 6/1941 | Rappaport | 15/104.33 |
| 2,284,939 | 6/1942 | Asnard | 15/104.33 |
| 2,661,489 | 12/1953 | Rudolph et al. | 15/104.33 |
| 2,769,191 | 11/1956 | Hunt et al. | 15/104.33 |
| 2,819,481 | 1/1958 | Lockert | 15/104.33 |
| 3,224,024 | 12/1965 | Hunt | 15/104.33 |
| 3,449,782 | 6/1969 | Hunt | 15/104.33 |
| 3,609,788 | 10/1971 | Mier | 15/104.33 |
| 3,897,602 | 8/1975 | Waterbury | 15/104.33 |
| 4,317,247 | 3/1982 | Levine | 15/104.33 |
| 4,956,889 | 9/1990 | Kirk | 15/104.33 |
| 5,029,356 | 7/1991 | Silverman et al. | 15/104.33 |
| 5,640,736 | 6/1997 | Salecker | 15/104.33 |
| 5,901,401 | 5/1999 | Rutkowski et al. | 15/104.33 |
| 5,987,684 | 11/1999 | Evans | 15/104.33 |

OTHER PUBLICATIONS

K–Spin Hand Spinner, p. 115, RIDGID Catalog No. RT–198, Mar. 1998, U.S.A.

*Primary Examiner*—Robert J. Warden, Sr.
*Assistant Examiner*—Theresa T. Snider
*Attorney, Agent, or Firm*—Vickers, Daniels & Young

[57] ABSTRACT

A hand held and hand operated drain cleaning tool including a drain cleaning cable coiled in a drum and having a support for holding the drum in one hand while rotating the drum with the other through a crank on the drum is provided with a cable feeding device operable by a feed actuator which is displaceable by the one hand of a user to feed the cable relative to the drum while the one hand supports the drum and the other hand rotates the drum.

38 Claims, 9 Drawing Sheets

FEED CONTROL DEVICES FOR HAND OPERATED DRAIN CLEANING TOOLS

BACKGROUND OF THE INVENTION

This invention relates to the art of drain cleaning tools and, more particularly, to cable feeding devices for hand held and hand operated drain cleaning tools.

Hand held and hand operated drain cleaning tools have been provided heretofore and generally, as shown in U.S. Pat. No. 2,284,939 to Asnard for example, are comprised of a drain cleaning cable or snake coiled in a cable drum which is rotatable relative to a support by which the drum is adapted to be held in one hand of a user while the latter rotates the drum with his or her other hand through a crank on the drum. The cable extends forwardly of the drum and is extended relative thereto for insertion into a drain to be cleaned and rotates with the drum so as to clear a blockage encountered in the drain. Further in this respect, as disclosed in the Asnard patent, a length of the cable is adapted to be manually withdrawn from the drum by the user, and then a thumb screw is tightened against the cable at the forward end of the drum so as to preclude unintended displacement of the cable into the drum as the cable is advanced into the drain to be cleaned. The drum is then held with one hand and rotated by the other while the user at the same time forces the cable into the drain. When the withdrawn length of the cable has been inserted into the drain, the thumb screw is loosened, the cable is held in place and the drum is withdrawn from the entrance to the drain to withdraw a further length of cable from the drum. Then, the thumb screw is again tightened and the operation is repeated to displace the newly extended length of the cable to the drain. In the Asnard patent, the hand support for holding the drum for rotation is a tubular support at the rear end of the drum and, in other previous support arrangements, such a tubular support is disposed forwardly of the drum and may include a pistol grip type handle extending laterally of the axis of rotation for supporting the drum. A hand held and hand operated tool of the latter structure is available from The Ridge Tool Company of Elyria, Ohio under the latter's product designation K-Spin Hand Spinner. When the drain cleaning operation is completed, the thumb screw is loosened and the cable is manually pushed back into the drum by the user.

Hand held and hand operated drain cleaning tools of the foregoing character are desirable in that they are lightweight, structurally simple, economical to manufacture, and, for all of these reasons, ideal for use in connection with light duty drain cleaning operations such as those encountered in a residential home. At the same time, the necessity to manually extend and retract the cable relative to the drum and to tighten and loosen the thumb screw in connection with inserting and rotating the cable relative to a drain to be cleaned is cumbersome, difficult at times such as in connection with moving the leading end of the cable around a sharp bend in the drain line, and is dirty as a result of sludge and other material adhering to the cable and contacting the hand of the user in connection with extending and retracting the cable relative to the dram. Should the user of the tool encounter an obstruction in the drain line while a considerable length of the cable extends outwardly from the drain entrance, rotation of the cable can result in the latter whipping about the axis of the drain as opposed to rotating about its own axis, and such whipping can damage the area adjacent the drain entrance. Further, it becomes frustrating, awkward and difficult in such situations to loosen the thumb screw to retract the extra cable into the drum without pulling the cable from the drain, tightening the thumb screw and then pushing and rotating the drum in an effort to advance the snake. Further frustration results from having to repeat the thumb screw loosening, cable pulling, thumb screw tightening, and drum pushing and rotating procedure, sometimes several times in order to move the leading end of the cable through or past the obstruction. While the foregoing problems and difficulties are minimized or avoided in connection with the operation of motor powered drain cleaning apparatus by providing the latter with cable feeding mechanisms operable in response to rotation of the drum and cable to automatically feed the latter relative to the drum, such feeding devices heretofore available are structurally complex, expensive, structurally and/or functionally complicated and/or inoperable in connection with a hand held and hand operated drain cleaning tool in which the drum is supported by one hand of a user and rotated by the other.

SUMMARY OF THE INVENTION

In accordance with the present invention, feeding arrangements are provided for hand held and hand operated drain cleaning tools of the foregoing character which avoid or minimize the problems and difficulties encountered in connection with the use thereof and which provide the advantages realized in connection with the use of cable feeding devices with power driven drain cleaning apparatus while promoting and maintaining the desired simplicity of structure and economy of manufacture and ease of use of a hand held and hand operated drain cleaning tool. More particularly in this respect, feeding devices according to the invention include cable driving components mounted on the drum support and a manually operated drive actuator mounted on the drum support for selective displacement by the user between operating and non-operating conditions relative to the cable for respectively feeding the cable relative to the drum and interrupting the cable feed. Importantly, the manually operable drive actuator is positioned for operative displacement by the user using the fingers of the one hand by which the drum is supported while the drum is being rotated by the other hand of the user. In accordance with one embodiment, the drum support includes a hand grip by which the drum is supported by the one hand of the user, and the drive actuator includes a trigger forwardly adjacent the hand grip which is selectively displaceable by the user while he or she supports the drum in the one hand and rotates the drum with the other. In accordance with another embodiment, the drum support includes a cradle-like portion extending forwardly of the drum and by which the latter is adapted to be supported by one hand of a user, and the manually operable drive actuator is diametrically opposed to the cradle-like portion and is selectively displaceable by the fingers and/or thumb of the one hand of the user while the latter rotates the drum with his or her other hand. In this embodiment, the cradle and drive actuator components structurally provide a tubular configuration in which the parts are adapted to be radially constricted in response to a squeezing type gripping of the components.

Advantageously, a feeding device in accordance with the present invention comprises just three feed rollers and one drive actuator, thus minimizing the number of component parts, and maintaining a desired lightweight and economical cost of production while improving the ease and convenience of use heretofore experienced with hand held and hand operated drain cleaning tools by eliminating the need to manually displace the cable relative to the drum in connection with the performing of a drain cleaning operation.

It is accordingly an outstanding object of the present invention to provide a hand held and hand operated drain cleaning tool with a cable feeding device for axially displacing a drain cleaning cable relative to the storage drum thereof in response to rotation of the drum as the latter is supported by one hand of a user and rotated by the user's other hand.

Another object is the provision of a cable feeding device for a drain cleaning tool of the foregoing character which is selectively operable by the user of the tool in conjunction with the latter's support of the tool during use thereof to engage and feed the cable or to release the cable for rotation with the cable drum without axial displacement.

Still another object is the provision of a cable feeding device for a drain cleaning tool of the foregoing character which promotes maintaining a lightweight characteristic of the tool and the ease and convenience of use thereof while eliminating the need to manually displace the cable relative to the tool drum in order to perform a drain cleaning operation therewith.

A further object is the provision of a cable feeding device for a drain cleaning tool of the foregoing character which is comprised of a minimum number of parts and is structurally simple, thereby promoting maintaining the economical production characteristic of the tool.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
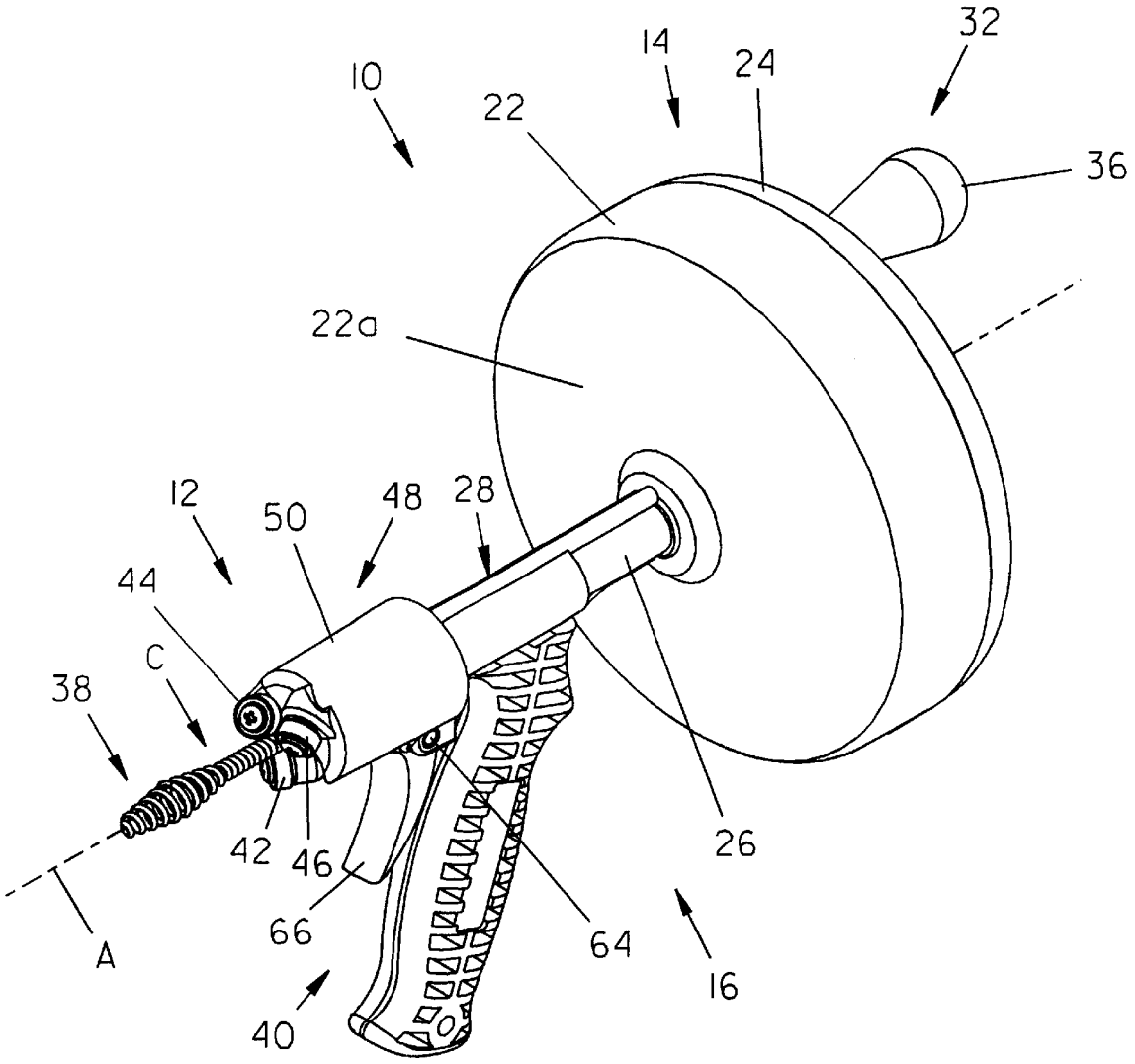
FIG. 1 is a perspective view of one embodiment of a hand held and hand operated drain cleaning tool having a cable feed device in accordance with the present invention.
Figure 5:
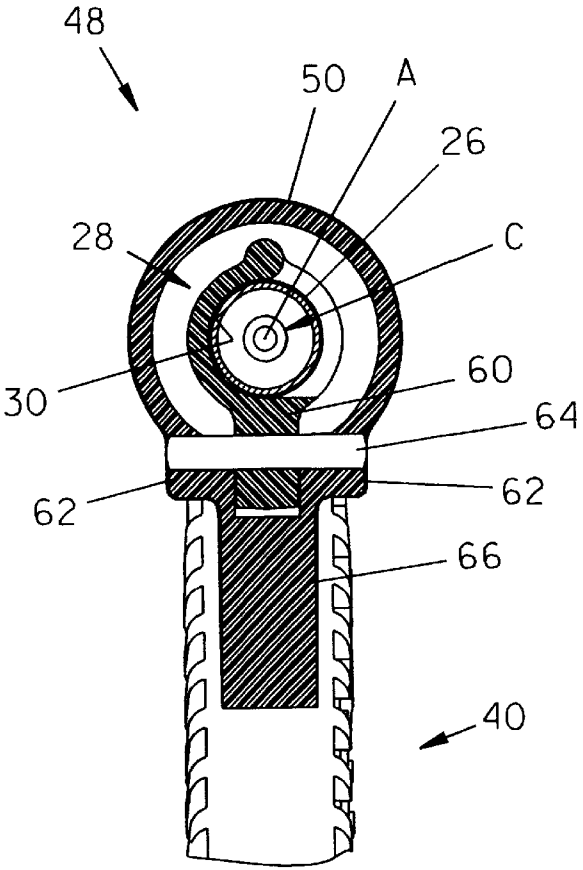
FIG. 5 is a cross-sectional elevation view through the pivot axis of the actuator arm of the feed device taken along line 5—5 in FIG. 4.
Figure 2:
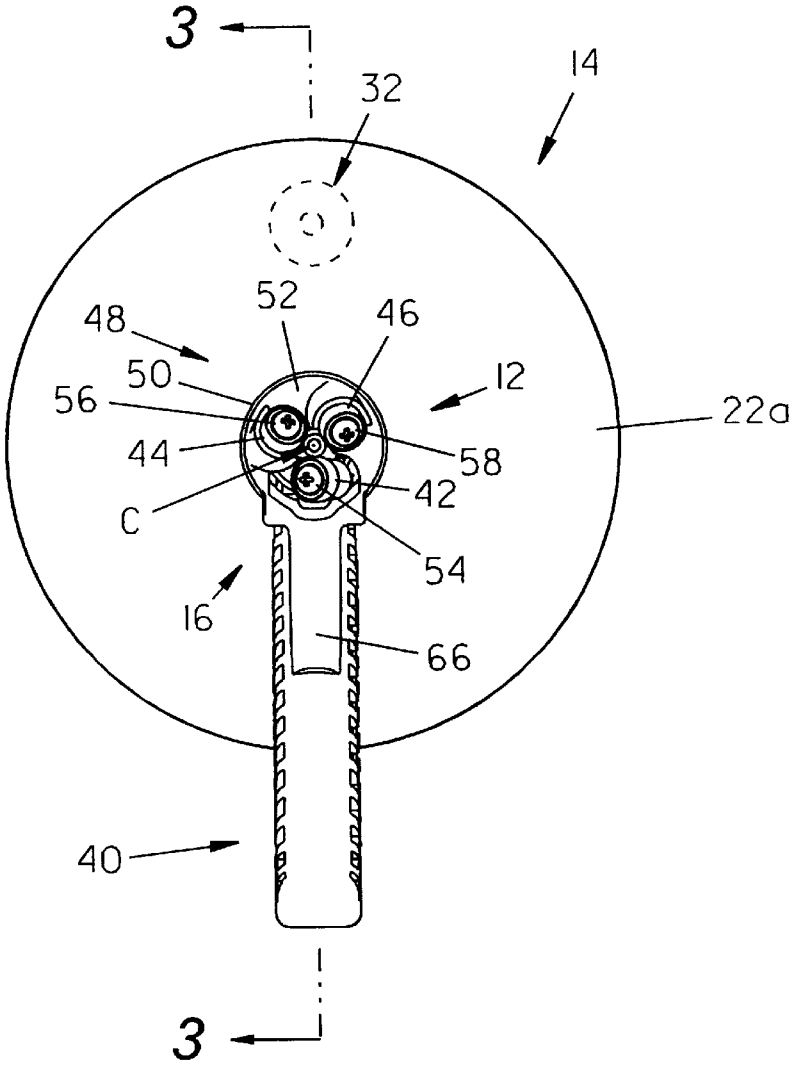
FIG. 2 is a front elevation view of the tool and feed mechanism shown in FIG. 1.
Figure 3:
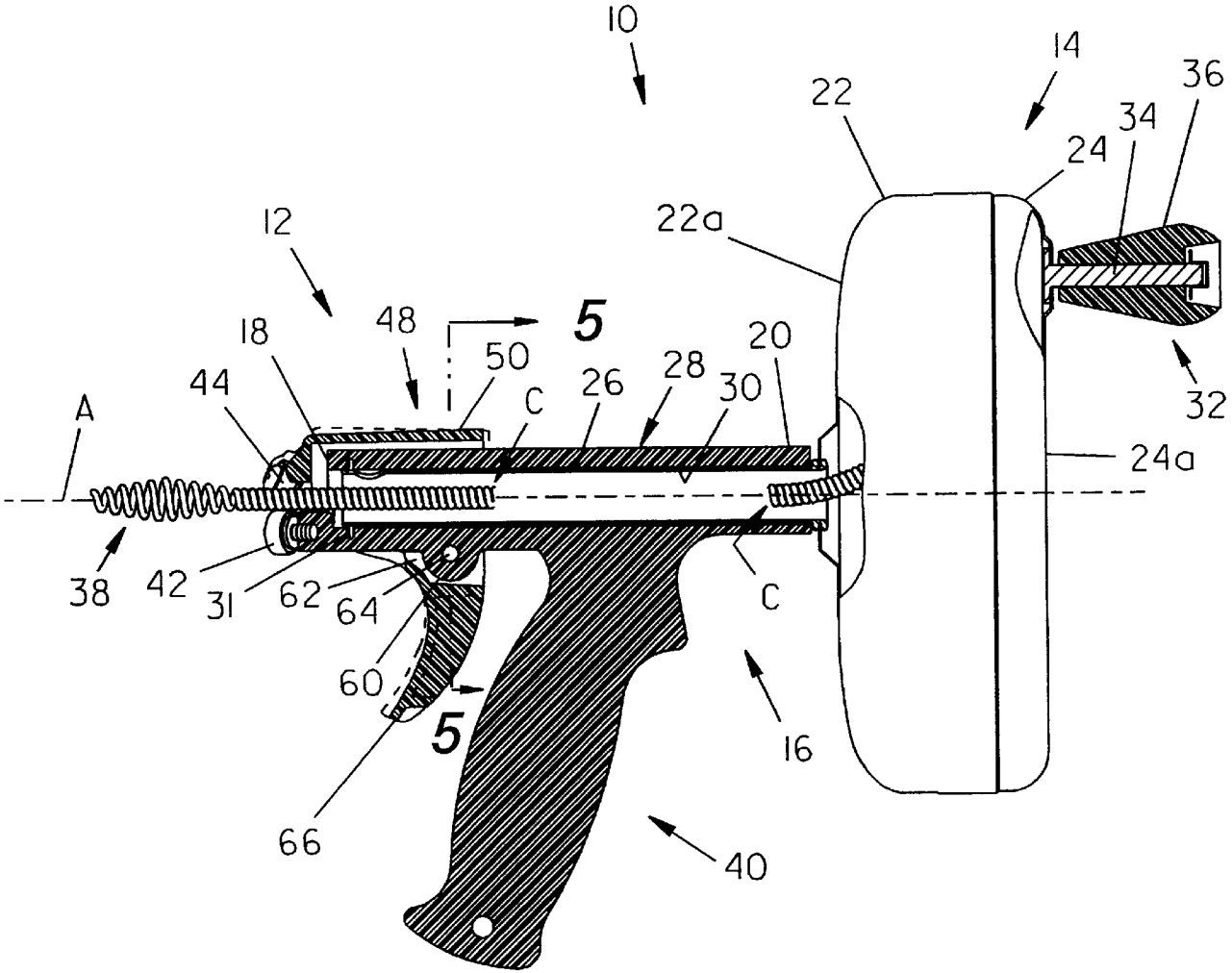
FIG. 3 is a sectional elevation view of the tool and feed mechanism taken along line 3—3 in FIG. 2.

Referring now in greater detail to the drawings, wherein the showings are for the purpose of illustrating preferred embodiments of the invention only, and not for the purpose of limiting the invention, FIGS. 1–5 of the drawing illustrate a hand held and hand operated drain cleaning tool 10 having a manually operable cable feeding device 12 mounted thereon for selectively displacing a drain cleaning cable C relative to tool 10 and into and out of a drain to be cleaned. Drain cleaning tool 10 comprises a cable drum 14 and a drum support 16 having front and rear ends 18 and 20, respectively. Drum 14 is at rear end 20 of support 16 and comprises front and rear drum portions 22 and 24, respectively, of a suitable metal such as steel and which portions are axially interengaged and joined such as by heat welding. The drum portions provide the drum with front and rear walls 22*a* and 24*a*, respectively, and front wall 22*a* is provided with an opening, not designated numerically, which is coaxial with axis A and through which drum support tube 26 coaxial with axis A is suitably secured to the front wall. Drum support 16 is constructed of a suitable plastic material such as polypropylene and includes a tubular body portion 28 at the upper end thereof which provides a passageway 30 through which drum support tube 26 extends toward front end 18 of the support. Passageway 30 interengages with tube 26 to support drum 14 for rotation about axis A, and the front end of drum support tube 26 is suitably interengaged with portion 28 of the drum support against axial separation of the drum therefrom, such as by a retaining ring 31. Rear wall 24*a* of the drum is provided with a crank arm 32 radially offset from axis A to facilitate manual rotation of drum 14 about axis A relative to drum support 16. Crank arm 32 is provided by a metal pin 34 suitably secured to rear wall 24*a* of the drum and a handle member 36 of a suitable plastic material mounted on pin 34 and supported thereon for rotation relative thereto and against axial separation therefrom. Drum support 16 further includes a pistol-type hand grip 40 integral with and extending downwardly from the upper tubular body portion 28 of the support intermediate front and rear ends 18 and 20 of the support. Drain cleaning cable C, as is conventional, is an elongate, flexible member made of tightly wound spring wire, and the cable is coiled in drum 14 about axis A and has an inner end in the drum. The free or outer end of the cable extends through drum support tube 26 and outwardly beyond front end 18 of the drum support and, in the embodiment illustrated, the outermost end of the cable is formed to provide an auger tip 38.

In accordance with the present invention, feed device 12 is mounted on front end 18 of drum support 16 and, in the embodiment illustrated in FIGS. 1–5, comprises a cable driving roll 42 mounted on the lower side of the tubular body portion 28 of the drum support at front end 18 and a pair of actuator rolls 44 and 46 mounted on an actuator arm 48 of the feed device for radially engaging and displacing cable C against driving roll 42 to feed cable C axially inwardly or outwardly relative to drum 14. Preferably, actuator arm 48 is constructed of a suitable plastic such as polypropylene and includes a circular skirt portion 50 extending axially of and circumferentially about front end 18 of the drum support, and a front wall 52 extending downwardly across the outermost end of the drum support transverse to axis A. Drive roll 42 is mounted on drum support 16 by a cap screw 54, and actuator rolls 44 and 46 are mounted on front wall 52 of actuator arm 48 by cap screws 56 and 58, respectively. Cap screws 54, 56 and 58 provide axes of rotation for the corresponding roll, and each roll axis is skewed both horizontally and vertically relative to drum axis A and, preferably, at an angle of about 30° with respect to each direction. The driving and actuator rolls have smooth outer surfaces, and the skewed mounting thereof provides for driving snake C axially when the snake is rotated and displaced against driving roll 42 as set forth more fully hereinafter.

Figure 4:
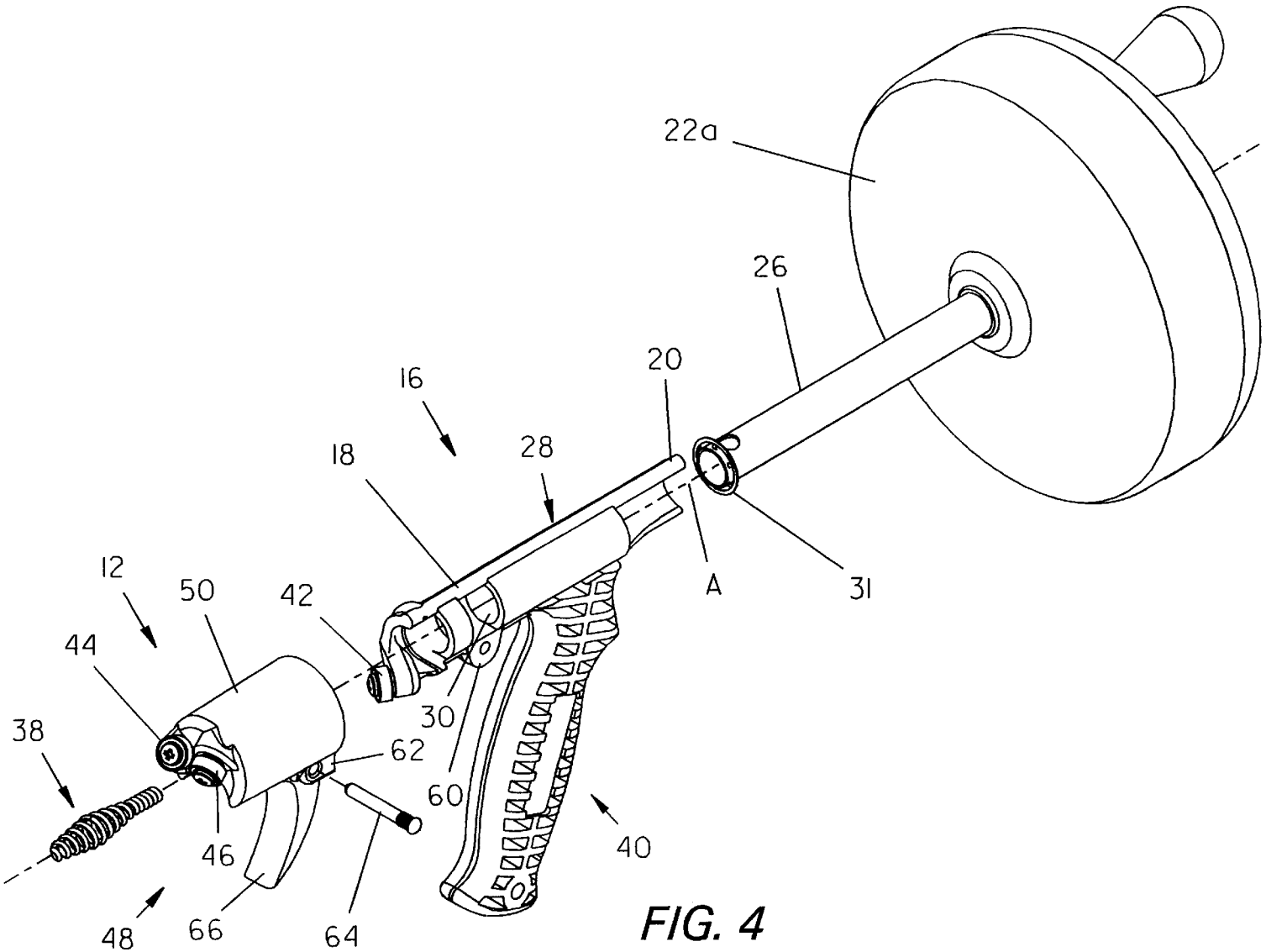
FIG. 4 is an exploded perspective view of the tool and feed mechanism shown in FIG. 1.
Figure 6:
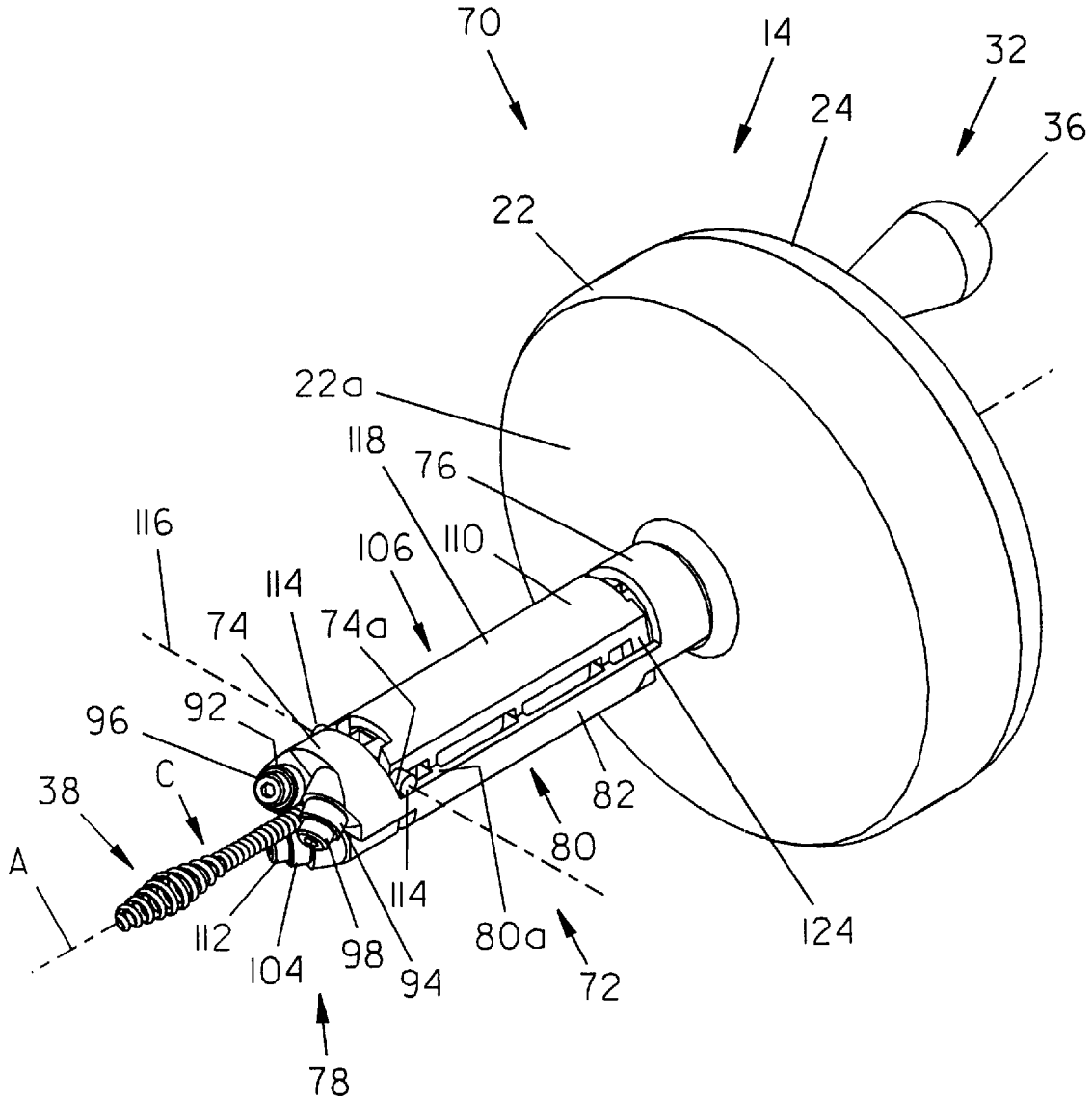
FIG. 6 is a perspective view of another embodiment of a hand held and hand operated drain cleaning tool having a cable feed device in accordance with the present invention.
Figure 7:
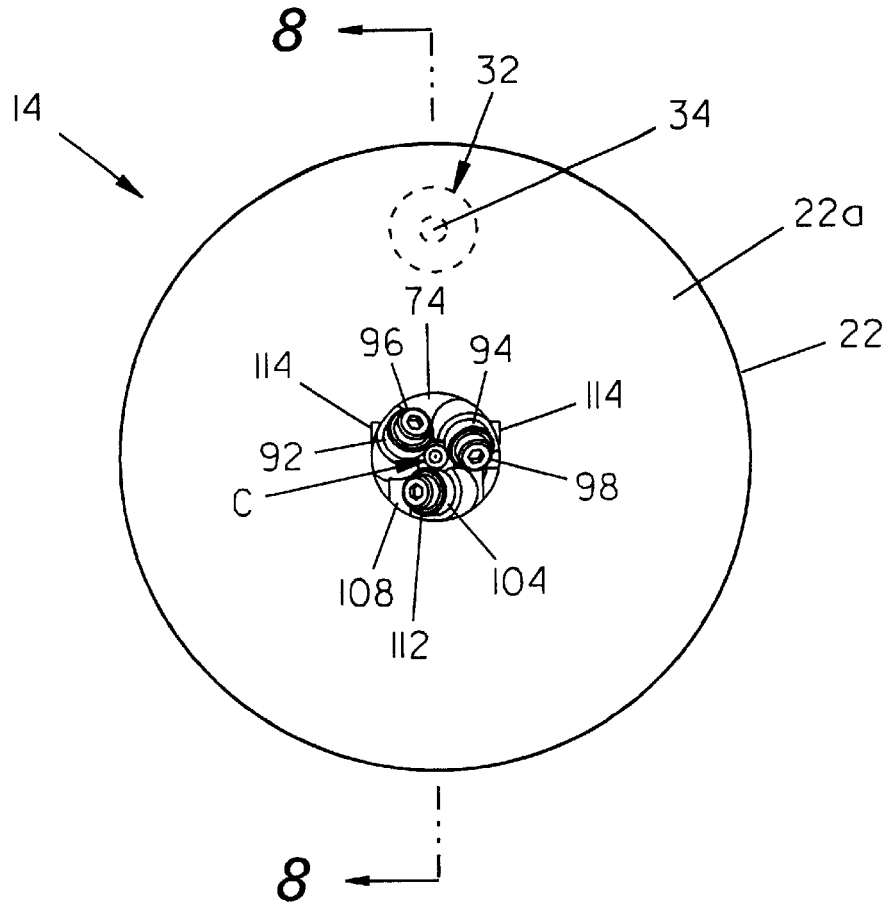
FIG. 7 is a front elevation view of the tool and cable feeding device shown in FIG. 6.

Actuator arm 48 is mounted on the front end of tubular body portion 28 of support 16 for pivotal displacement in opposite directions about an arm axis transverse to and below drum axis A. For this purpose, and as best seen in FIGS. 4 and 6, the lower side of tubular body portion 28 is provided with a mounting lug 60 which extends downwardly between laterally spaced apart mounting ears 62 on the lower axially inner end of skirt 50 of the actuator arm. Lug 60 and ears 62 are pivotally interconnected by a pin 64 which provides the arm axis. Further, actuator arm 48 is provided with a trigger 66 which extends downwardly from mounting ears 62 axially forwardly adjacent hand grip 40 whereby, with regard to the orientation of the parts in FIGS. 1 and 3, a finger or fingers of the hand of a person supporting the drum by holding hand grip 40 can pivot actuator arm 48 counterclockwise about pin 64 to the solid line position thereof in FIG. 3 to displace actuator rolls 44 and 46 radially inwardly against cable C so as to displace the latter against drive roll 42. When actuator arm 48 is so displaced and the user of the tool rotates cable drum 14 with the other hand by grasping and rotating crank arm 32 about axis A, cable C is axially displaced inwardly or outwardly relative to drum 14 depending on the direction of rotation of the latter.

Generally, the drain cleaning cable is advanced axially forwardly of drum 14 in response to clockwise rotation of the latter and is retracted into the drum in response to counterclockwise rotation of the drum. Accordingly, it will be appreciated that a user of the tool can quickly and easily advance the cable into a drain to be cleaned without having to physically pull a length of cable from the drum and manually push the cable into the drain and that, advantageously, the cable is continuously rotated as it advances axially into the drain. This promotes axial movement of the cable around sharp bends and across drain joints whereas, with manually operated drain cleaning devices heretofore available, such movement required the operator to manually grasp the cable and reciprocate the latter in axially opposite directions in an effort to move the free end of the cable around bends and past drain joints. If an obstruction is encountered which stops or impedes axial advancement of the free end of the snake and the drain, the user can release trigger 66 and continue to rotate the cable until the obstruction is dislodged or penetrated by the cable. While a spring could be associated with actuator arm 48 for biasing the arm and thus actuator rolls 44 and 46 radially outwardly of axis A to the operative position thereof shown by broken lines in FIG. 3, such biasing is not necessary in view of the lightweight construction of the actuator arm and thus minimal wearing interengagement of the drive and actuator rolls with cable C when the actuator arm is in its released or inoperative condition.

Figure 10:
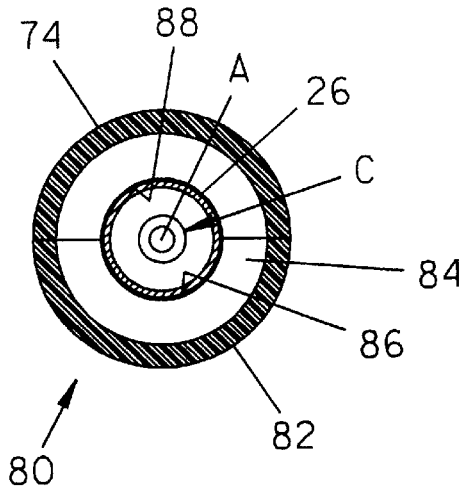
FIG. 10 is a cross-sectional elevation view taken along line 10—10 in FIG. 8.
Figure 8:
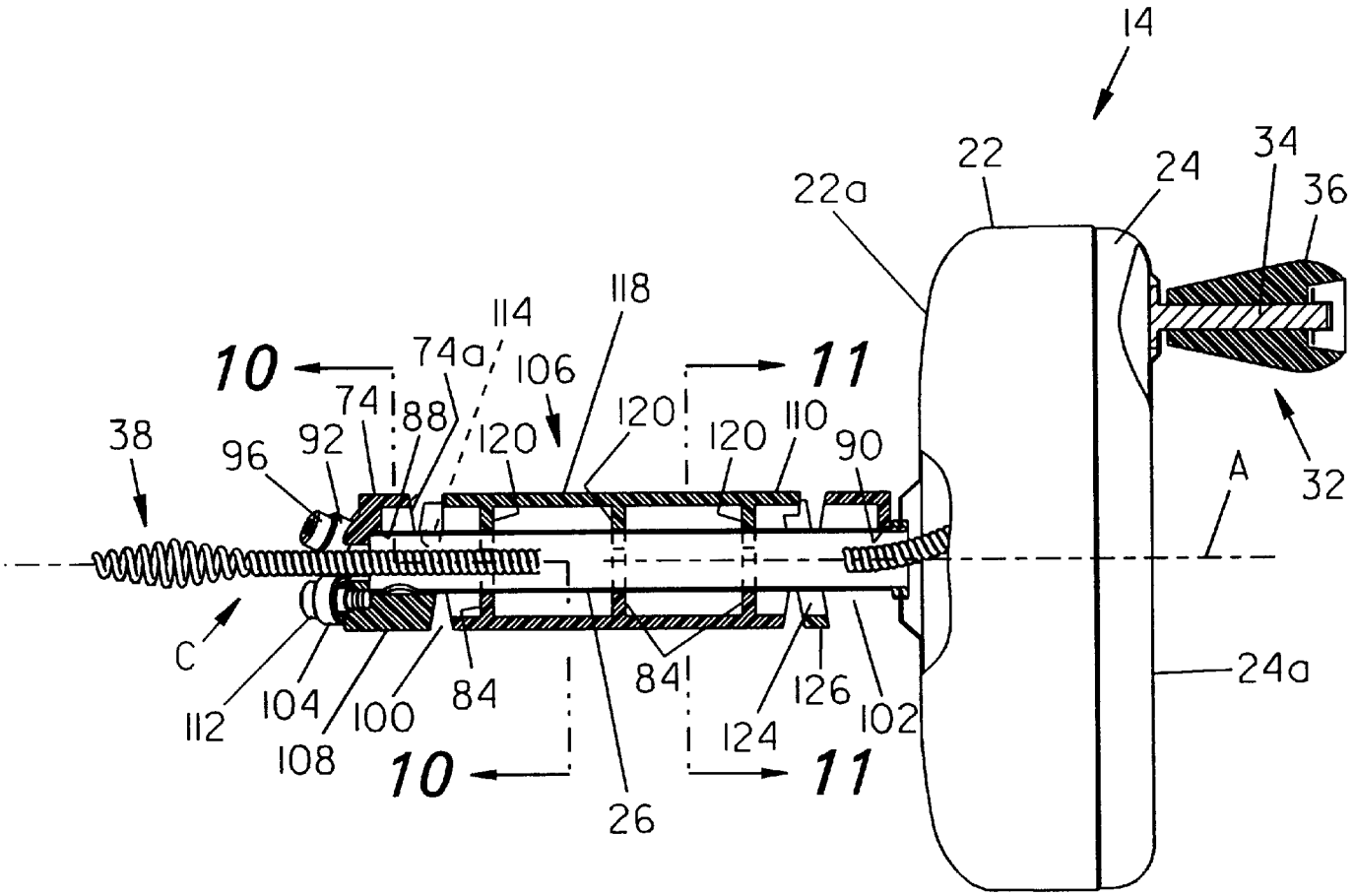
FIG. 8 is a sectional elevation view of the tool and feed mechanism taken along line 8—8 in FIG. 7 and showing the feed mechanism and its operable position.
Figure 9:
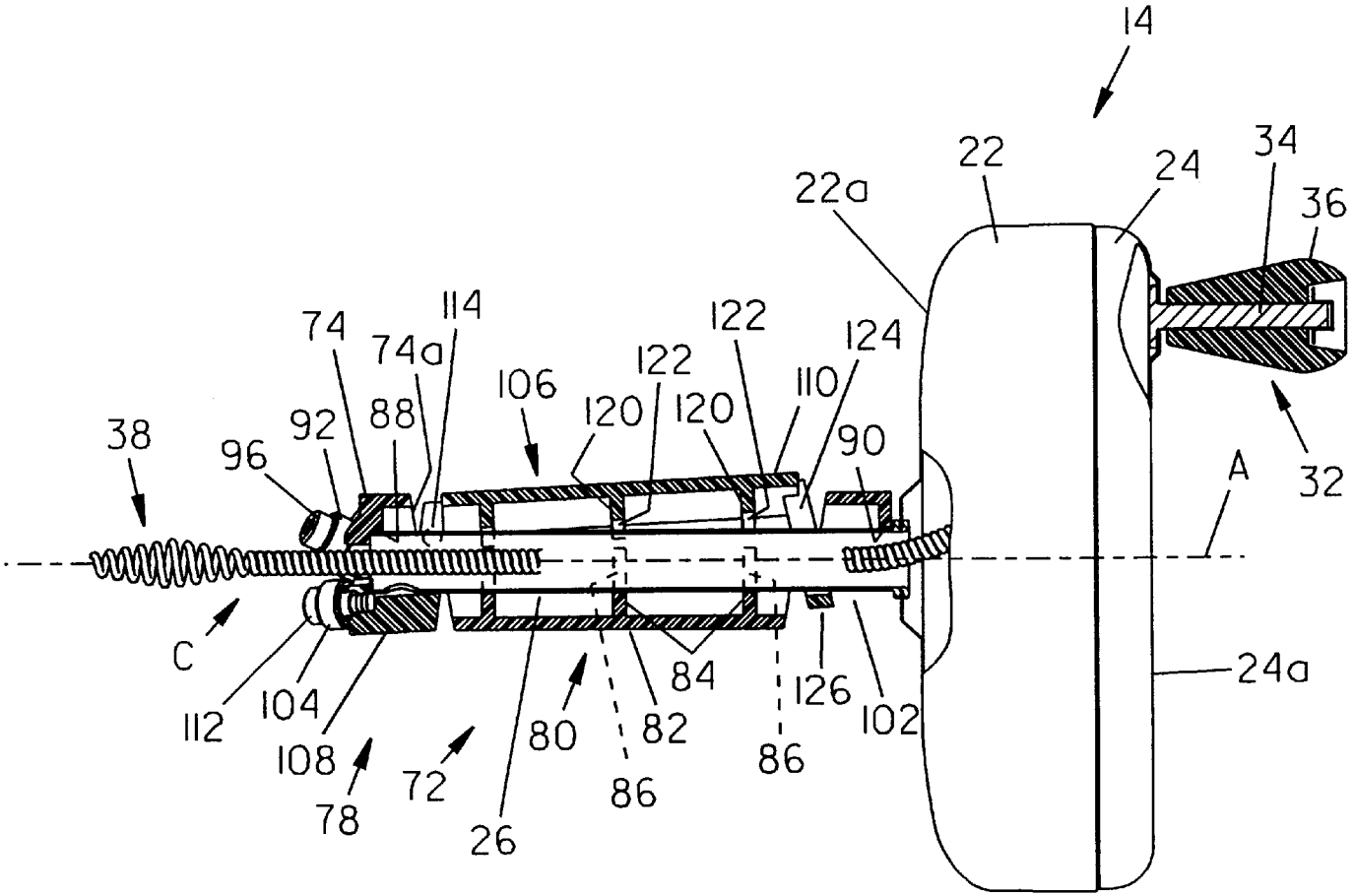
FIG. 9 is a sectional elevation view similar to FIG. 8 and showing the feed mechanism in its inoperable position.

Another embodiment of the invention is illustrated in FIGS. 6–12. In this embodiment, the drain cleaning tool 70 includes cable drum, drum support tube and crank arm components which are structurally identical to the corresponding components described hereinabove in connection with FIGS. 1–5 and, accordingly, are identified in FIGS. 6–12 by the same numerals as in FIGS. 1–5. The drain cleaning tool 70 further includes a drum support member 72 having front and rear ends 74 and 76, respectively, and a cable feed device 78 mounted on front end 74 and which is selectively operable as set forth hereinafter to feed drain cleaning cable C axially relative to drum 14. Support member 72 is preferably constructed of polypropylene and includes a cradle portion 80 intermediate the front and rear ends and which, as will be appreciated from FIGS. 8–12, is arcuate in cross section transverse to axis A and opens radially inwardly thereof. Further, the cradle portion has an outer surface 82 which extends axially between front and rear ends 74 and 76 substantially parallel to axis A. The radially inner side of cradle portion 80 is provided with a plurality of axially spaced apart ribs 84 having arcuate support surfaces 86 and, as best seen in FIGS. 8–10, front and rear ends 74 and 76 respectively have walls provided with radially inwardly open arcuate support surfaces 88 and 90 which are axially offset from and diametrically opposed to support surfaces 86. Accordingly, as will be appreciated from FIGS. 8–12, support surfaces 86, 88 and 90 cooperatively provide a passageway receiving and rotatably supporting drum tube 26 and thus the cable drum for rotation about axis A.

Figure 11:
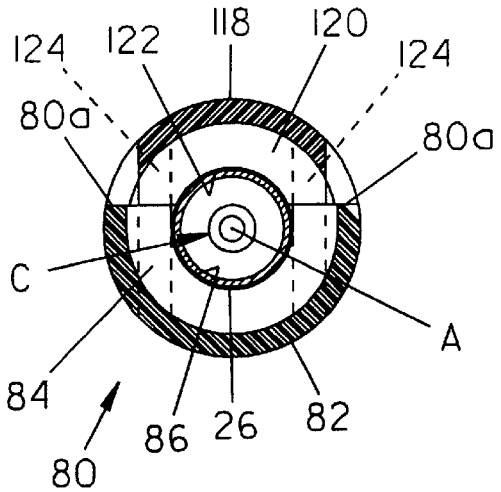
FIG. 11 is a cross-sectional elevation view taken along line 11—11 in FIG. 8; and, FIG. 12 is an exploded perspective view of the drum support and actuator arm components of the tool and feed mechanism shown in FIG. 6.
Figure 12:
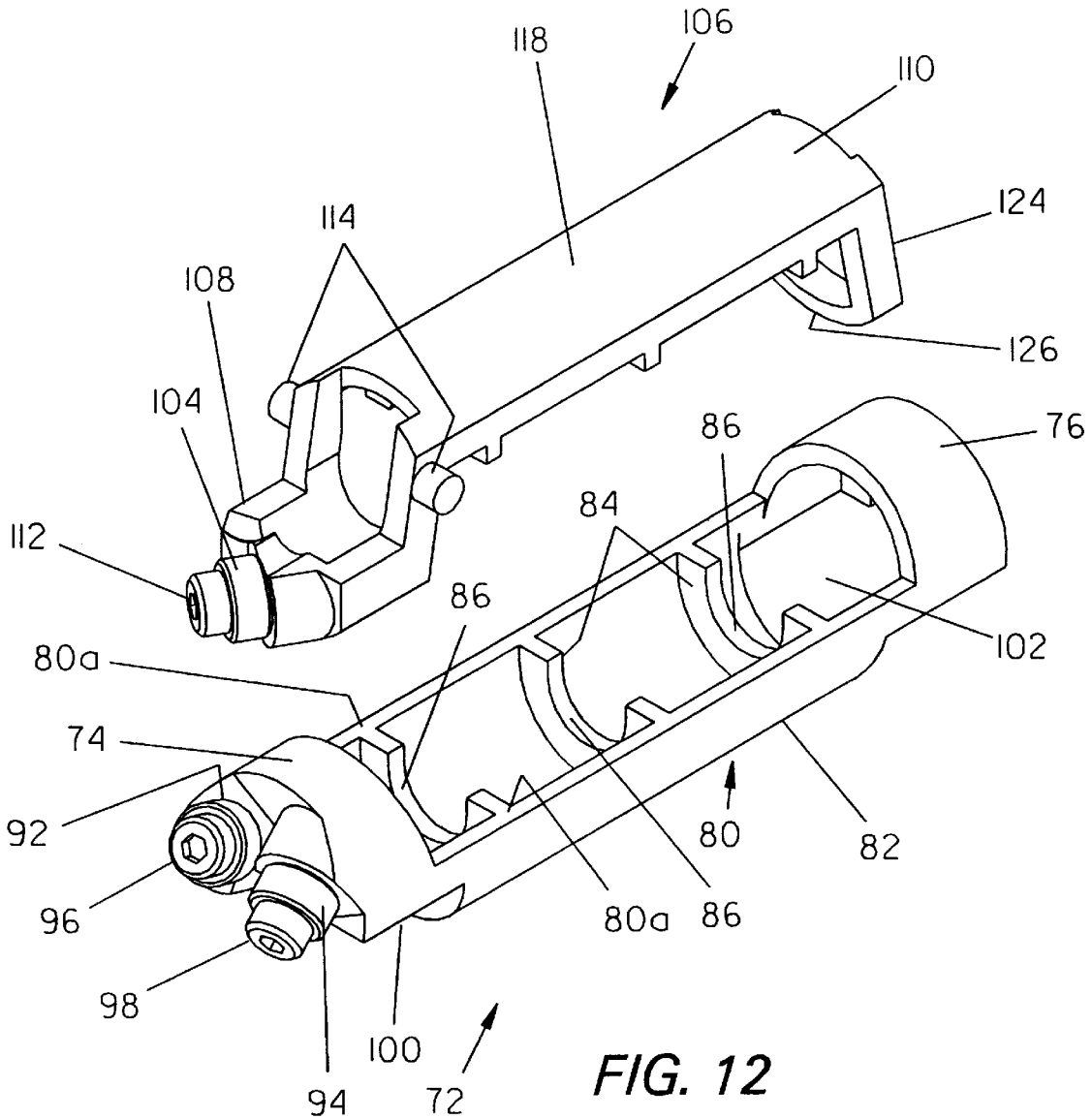

Feed device 78 includes a pair of cable drive rolls 92 and 94 mounted on front end 74 of support member 72 by socket head cap screws 96 and 98, respectively. As best seen in FIG. 12, the bottom of support member 72 is axially cut away both forwardly and rearwardly of cradle portion 80 to respectively provide openings 100 and 102 through the bottom of the support at the front and rear ends thereof for the purposes set forth hereinafter. Feed device 78 further includes a drive actuator roll 104 mounted on an actuator arm 106 which is pivotally supported on the front end of support member 72 in the manner set forth hereinafter and for the purpose of supporting roll 104 for radial displacement relative to axis A to engage cable C against drive rolls 92 and 94. Actuator arm 106 is preferably constructed of polypropylene and has front and rear ends 108 and 110, respectively, and actuator roll 104 is mounted on front end 108 by a socket head cap screw 112. As will be appreciated from FIGS. 8, 9 and 12 of the drawing, front end 108 of actuator arm 106 is adapted to be inserted downwardly through opening 100 at the front end of support member 72 such that front end 108 of the actuator arm underlies front end 74 of support member 72. When so disposed, as best seen in FIGS. 6 and 8, a pair of pivot pins 114 on the actuator arm rest on the upper edges 80*a* of cradle portion 80 at the juncture of edges 80*a* with edges 74*a* of front portion 74 of support member 72 to support actuator arm 106 for pivotal displacement relative to support member 72 about an arm axis 116 which is transverse to and spaced above drum axis A. Actuator arm 106 includes a portion 118 extending axially between the front and rear ends of the actuator arm and, as best seen in FIG. 11, portion 118 is arcuate in cross section transverse to drum axis A and opens radially inwardly thereof. The inner surface of portion 118 is provided with a plurality of ribs 120 axially spaced apart and having arcuate inner surfaces 122 diametrically opposed to surfaces 86 of ribs 84 on support member 72. Surfaces 122 are adapted to engage against drum support tube 26 to limit pivotal displacement of the actuator arm radially inwardly of axis A. Rear end 110 of the actuator arm comprises laterally spaced apart legs 124 extending downwardly from portion 118 and interconnected at their lower ends by a bridging portion 126. When the support member and actuator arm are assembled on drum support tube 26, the latter extends between legs 124, and bridging portion 126 serves to limit displacement of the actuator arm radially outwardly of drum axis A.

As described hereinabove in connection with the embodiment of FIGS. 1–5, socket head cap screws 96, 98 and 112 provide axes of rotation for the drive and actuator rolls and which axes, preferably, are skewed both horizontally and vertically relative to drum axis A at an angle of about 30° with respect to each direction. In operation, as will be appreciated from FIGS. 8 and 9, a user supports drum 14 by holding support member 72 in one hand and then rotates the drum through crank arm 32 to rotate cable C about the drum axis. By squeezing actuator arm 106 with the one hand holding support member 72, the arm is displaced from the inoperative position shown in FIG. 9 to the operation position shown in FIG. 8, whereby actuator roll 104 is displaced radially inwardly against cable C so as to displace the latter against drive rolls 92 and 94. The skewed mounting of the actuator and drive rolls then provides for driving cable C axially of drum 14 when the drum and thus cable C is rotated. Again, the direction of displacement of cable C is dependant upon the direction of rotation of drum 14 about axis A and, in connection with feeding cable C into a drain to be cleaned, the operator can release his or her grip on actuator arm 106 so as to arrest the advancing movement and allow the snake to rotate without advancement. While the foregoing description has been with regard to support member 72 underlying axis A, it will be appreciated that the support member and actuator arm assembly 106, being in the form of a hand grip, can be angularly oriented in any position which is comfortable for the user in connection with supporting the drum in one hand, rotating the drum with the other hand, and displacing the actuator arm with the one hand to feed the cable while rotating the drum with the other hand.

While considerable emphasis has been placed herein on the structures and structural interrelationships between the component parts of the embodiments disclosed, it will be appreciated that other embodiments of the invention can be made and that many changes can be made in the embodiments illustrated and described without departing from the principles of the invention. Accordingly, it is to be distinctly understood that the foregoing descriptive matter is to be interrupted merely as illustrative of the present invention and not as a limitation.

Having thus described the invention, it is so claimed:

1. In a hand held and hand operated drain cleaning tool comprising a rotatable cable drum having a drum axis, a crank arm on said drum for rotating said drum by hand, a drain cleaning cable coiled in said drum for rotation therewith and having an end for extending from said drum and into a drain to be cleaned, and a drum support supporting said drum for rotation about said drum axis and including means for a user to support said drum in one hand while rotating the drum with the other hand, the improvement comprising: a cable feeding device for axially displacing said cable relative to said drum in response to rotation of said drum and cable, said feeding device including cable driving roll means on said support and a manually operated drive actuator on said support separate from said means for supporting said drum in one hand and operable by the one hand to radially displace said cable against said cable driving roll means while the same one hand also supports the drum leaving the other hand free to rotate the drum.

2. A drain cleaning tool according to claim 1, wherein said support has axially spaced apart front and rear ends, said drum being at said rear end, said cable feeding device being at said front end, and said means for supporting said drum in one hand being between said front and rear ends.

3. A drain cleaning tool according to claim 1, wherein said drive actuator includes an actuator arm mounted on said support for pivotal displacement about a pivot axis transverse to said drum axis, and actuator roll means mounted on said arm for displacement therewith.

4. A drain cleaning tool according to claim 3, wherein said cable driving roll means and said actuator roll means are rotatable about corresponding roll axes skewed relative to said drum axis.

5. A drain cleaning tool according to claim 1, wherein said cable driving roll means includes a driving roll on said support, and said drive actuator includes an actuator arm mounted on said support for pivotal displacement about a pivot axis transverse to said drum axis, and a pair of actuator rolls mounted on said arm for displacement therewith.

6. A drain cleaning tool according to claim 5, wherein said driving roll and said actuator rolls are each rotatable about a corresponding roll axis skewed relative to said drum axis.

7. A drain cleaning tool according to claim 1, wherein said driving roll means includes a pair of driving rolls on said support, and said drive actuator includes an actuator arm mounted on said support for pivotal displacement about a pivot axis transverse to said drum axis and an actuator roll mounted on said arm for displacement therewith.

8. A drain cleaning tool according to claim 7, wherein each of said driving rolls and said actuator roll is rotatable about a corresponding roll axis skewed relative to said drum axis.

9. A drain cleaning tool according to claim 1, wherein said support includes a body portion having axially spaced apart front and rear ends, said drum being at said rear end, and said means for supporting said drum in one hand including a hand grip between said front and rear ends and extending laterally outwardly from said body portion.

10. A drain cleaning tool according to claim 1, wherein said support has axially spaced apart front and rear ends, said drum being at said rear end, and said means for supporting said drum in one hand including a portion of said support between said front and rear ends having an outer surface generally parallel to said drum axis.

11. In a hand held and hand operated drain cleaning tool comprising a rotatable cable drum having a drum axis, a crank arm on said drum for rotating said drum by hand, a drain cleaning cable coiled in said drum for rotation therewith and having an end for extending from said drum and into a drain to be cleaned, and a drum support supporting said drum for rotation about said drum axis and including means for a user to support said drum in one hand while rotating the drum with the other hand, the improvement comprising: a cable feeding device for axially displacing said cable relative to said drum in response to rotation of said drum and cable, said feeding device including cable driving roll means on said support and a manually operated drive actuator on said support separate from said means for supporting said drum in one hand and operable by the one hand to radially displace said cable against said cable driving roll means while the one hand supports the drum and the other hand rotates the drum, said support including a body portion having axially spaced apart front and rear ends, said drum being at said rear end, and said means for supporting said drum in one hand including a hand grip between said front and rear ends and extending laterally outwardly from said body portion, said cable driving roll means is at said front end of said body portion and said drive actuator includes an actuator arm mounted on said body portion for pivotal displacement about an arm axis transverse to said drum axis, and actuator roll means mounted on said arm for displacement therewith, said actuator arm including a trigger portion forwardly adjacent said hand grip for pivoting said actuator arm to radially displace said actuator roll means against said cable.

12. A drain cleaning tool according to claim 11, wherein said cable driving roll means includes a driving roll mounted on said body and said actuator roll means includes a pair of actuator rolls mounted on said actuator arm.

13. A drain cleaning tool according to claim 12, wherein said driving roll and said actuator rolls are each rotatable about a corresponding roll axis skewed relative to said drum axis.

14. In a hand held and hand operated drain cleaning tool comprising a rotatable cable drum having a drum axis, a crank arm on said drum for rotating said drum by hand, a drain cleaning cable coiled in said drum for rotation therewith and having an end for extending from said drum and into a drain to be cleaned, and a drum support supporting said drum for rotation about said drum axis and including means for a user to support said drum in one hand while rotating the drum with the other hand, the improvement comprising: a cable feeding device for axially displacing said cable relative to said drum in response to rotation of said drum and cable, said feeding device including cable driving roll means on said support and a manually operated drive actuator on said support separate from said means for supporting said drum in one hand and operable by the one hand to radially displace said cable against said cable driving roll means while the one hand supports the drum and the other hand rotates the drum, said support having axially spaced apart front and rear ends, said drum being at said rear end, and said means for supporting said drum in one hand including a portion of said support between said front and rear ends having an outer surface generally parallel to said drum axis, said cable driving roll means is at said front end of said support and said drive actuator includes an actuator arm mounted on said support for pivotal displacement about an arm axis transverse to said drum axis, and actuator roll means mounted on said arm for displacement therewith, said actuator arm extending axially of said support and being pivotally displaceable toward said drum axis to radially displace said actuator roll means against said cable.

15. A drain cleaning tool according to claim 14, wherein said actuator arm is diametrically opposite said portion of said support.

16. A drain cleaning tool according to claim 15, wherein said cable driving roll means includes a pair of driving rolls mounted on said support and said actuator roll means includes an actuator roll mounted on said actuator arm.

17. A drain cleaning tool according to claim 16, wherein said driving rolls and said actuator roll are each rotatable about a corresponding roll axis skewed relative to said drum axis.

18. A hand held and hand operated drain cleaning tool comprising a rotatable cable drum having a drum axis, a drain cleaning cable coiled in said drum for rotation therewith and having an end for extending from said drum and into a drain to be cleaned, a drum support having front and rear ends, said drum being at said rear end of said support and mounted on said support for rotation about said drum axis, a crank arm on said drum for rotating said drum, said support including means for supporting said drum in one hand of a user while rotating the drum with the other hand, and a cable feeding device for axially displacing said cable relative to said drum in response to rotation of said drum and cable, said feeding device including cable driving roll means on said front end of said support, and a manually operated drive actuator separate from said means for supporting said drum in one hand, said actuator being pivotally mounted by the one hand to radially displace said cable against said driving roll means while the same one hand also supports the drum leaving the other hand free to rotate the drum.

19. A drain cleaning tool according to claim 18, wherein said drum has axially spaced front and rear walls, an opening through said front wall coaxial with said drum axis, a drum support tube coaxial with said opening and extending forwardly of said front wall to said front end of said support, said support interengaging with said tube to rotatably support said drum, said end of said cable extending through said opening and said support tube, and said crank arm being on said rear wall of said drum.

20. A drain cleaning tool according to claim 18, wherein said means for supporting said drum in one hand includes a hand grip extending laterally outwardly relative to said drum axis, and said drive actuator includes a trigger axially forwardly adjacent said hand grip for pivoting said drive actuator.

21. A drain cleaning tool according to claim 18, wherein said support includes a tubular body portion between said front and rear ends, said means for supporting said drum in one hand including a hand grip integral with and extending laterally outwardly from said body portion intermediate said front and rear ends, said drive actuator including an actuator arm pivotally mounted on said body portion between said hand grip and said front end of said support, actuator roll means on said arm for engaging said cable against said driving roll means, and a trigger axially forwardly adjacent said handle for pivoting said actuator arm.

22. A drain cleaning tool according to claim 21, wherein said tubular body portion is coaxial with said drum axis and has top and bottom sides with respect thereto, said hand grip and said trigger extending downwardly from said bottom side, and said driving roll means and said actuator roll means being respectively supported by said body portion and said actuator arm on opposite sides of said drum axis.

23. A drain cleaning tool according to claim 22, wherein said driving roll means includes a driving roll mounted on said front end for rotation about a driving roll axis, and said actuator roll means includes a pair of actuator roll mounted on said actuator arm for rotation about actuator roll axes.

24. A hand held and hand operated drain cleaning tool comprising a rotatable cable drum having a drum axis, a drain cleaning cable coiled in said drum for rotation therewith and having an end for extending from said drum and into a drain to be cleaned, a drum support having front and rear ends, said drum being at said rear end of said support and mounted on said support for rotation about said drum axis, a crank arm on said drum for rotating said drum, said support including means for supporting said drum in one hand of a user while rotating the drum with the other hand, and a cable feeding device for axially displacing said cable relative to said drum in response to rotation of said drum and cable, said feeding device including cable driving roll means on said front end of said support, and a manually operated drive actuator separate from said means for supporting said drum in one hand, said actuator being pivotally mounted by the one hand to radially displace said cable against said driving roll means while the one hand supports the drum and the other hand rotates the drum, said means for supporting said drum in one hand includes a portion of said support between said front and rear ends having an axially extending outer surface generally parallel to said drum axis, said drive actuator being pivotally mounted on said support adjacent said front end and extending toward said rear end and being pivotal toward said drum axis and said portion of said support to displace said cable against said driving roll means.

25. A hand held and hand operated drain cleaning tool comprising a rotatable cable drum having a drum axis, a drain cleaning cable coiled in said drum for rotation therewith and having an end for extending from said drum and into a drain to be cleaned, a drum support having front and rear ends. said drum being at said rear end of said support and mounted on said support for rotation about said drum axis, a crank arm on said drum for rotating said drum, said support including means for supporting said drum in one hand of a user while rotating the drum with the other hand, and a cable feeding device for axially displacing said cable relative to said drum in response to rotation of said drum and cable, said feeding device including cable driving roll means on said front end of said support, and a manually operated drive actuator separate from said means for supporting said drum in one hand, said actuator being pivotally mounted by the one hand to radially displace said cable against said driving roll means while the one hand supports the drum and the other hand rotates the drum, said support including a tubular body portion between said front and rear ends, said means for supporting said drum in one hand including a hand grip integral with and extending laterally outwardly from said body portion intermediate said front and rear ends, said drive actuator including an actuator arm pivotally mounted on said body portion between said hand grip and said front end of said support, actuator roll means on said arm for engaging said cable against said driving roll means, and a trigger axially forwardly adjacent said handle for pivoting said actuator arm, said tubular body portion is coaxial with said drum axis and has top and bottom sides with respect thereto, said hand grip and said trigger extending downwardly from said bottom side, and said driving roll means and said actuator roll means being respectively supported by said body portion and said actuator arm on opposite sides of said drum axis, said driving roll means including a driving roll mounted on said front end for rotation about a driving roll axis, and said actuator roll means includes a pair of actuator roll mounted on said actuator arm for rotation about actuator roll axes, said actuator arm is mounted on said bottom of said body portion for displacement about an arm axis below and transverse to said drum axis, said arm including a skirt portion extending upwardly and about said body portion from said arm axis and forwardly toward said front end of said support and having a front wall transverse to said drum axis and overlying said front end, and said actuator rolls being mounted on said front wall.

26. A drain cleaning tool according to claim 25, wherein each said driving roll axis and said actuator roll axes are skewed relative to said drum axis.

27. A drain cleaning tool according to claim 26, wherein said drum has axially spaced front and rear walls, an opening through said front wall coaxial with said drum axis, a drum support tube coaxial with said opening and extending forwardly of said front wall and through said tubular body portion to said front end of said support, said body portion interengaging with said tube to rotatably support said drum, said end of said cable extending through said opening and said support tube, and said crank arm being on said rear wall of said drum.

28. A hand held and hand operated drain cleaning tool comprising a rotatable cable drum having a drum axis, a drain cleaning cable coiled in said drum for rotation therewith and having an end for extending from said drum and into a drain to be cleaned, a drum support having front and rear ends, said drum being at said rear end of said support and mounted on said support for rotation about said drum axis, a crank arm on said drum for rotating said drum, said support including means for supporting said drum in one hand of a user while rotating the drum with the other hand, and a cable feeding device for axially displacing said cable relative to said drum in response to rotation of said drum and cable, said feeding device including cable driving roll means on said front end of said support, and a manually operated drive actuator separate from said means for supporting said drum in one hand, said actuator being pivotally mounted by the one hand to radially displace said cable against said driving roll means while the one hand supports the drum and the other hand rotates the drum, said means for supporting said drum in one hand includes a portion of said support extending axially between said front and rear ends and having an outer surface generally parallel to said drum axis, said portion of the support being arcuate in cross section transverse to said drum axis and opening radially inwardly relative thereto, said drive actuator including an actuator arm mounted on said front end of said support for pivotal displacement about an arm axis transverse to said drum axis and actuator roll means on said arm for engaging said cable against said driving roll means, and said arm extending axially from said arm axis toward said rear end of said support and being pivotal toward said drum axis and said portion of said support to displace said cable against said driving roll means.

29. A drain cleaning tool according to claim 28, wherein said actuator arm is arcuate in cross section transverse to said drum axis and opens radially inwardly relative thereto, said portion of said support and said actuator arm providing a passage between said front and rear ends of said support.

30. A drain cleaning tool according to claim 28, wherein said driving roll means and said actuator roll means are respectively mounted on said support and said actuator arm forwardly of said and axis.

31. A drain cleaning tool according to claim 28, wherein said driving roll means includes a pair of driving rolls mounted on said front end of said support for rotation about corresponding driving roll axes, and said actuator roll means includes an actuator roll mounted on said actuator arm for rotation about an actuator roll axis.

32. A drain cleaning tool according to claim 31, wherein said driving roll and said pair of actuator rolls are equally spaced apart about said drum axis.

33. A drain cleaning tool according to claim 31, wherein each of said driving roll axes and said actuator roll axis is skewed relative to said drum axis.

34. A drain cleaning tool according to claim 33, wherein said driving roll and said pair of actuator rolls are equally spaced apart about said drum axis.

35. A hand held and hand operated drain cleaning tool comprising a rotatable cable drum having a drum axis, a drain cleaning cable coiled in said drum for rotation therewith and having an end for extending from said drum and into a drain to be cleaned, a drum support having front and rear ends, said drum being at said rear end of said support and mounted on said support for rotation about said drum axis, a crank arm on said drum for rotating said drum, said support including means for supporting said drum in one hand of a user while rotating the drum with the other hand, and a cable feeding device for axially displacing said cable relative to said drum in response to rotation of said drum and cable, said feeding device including cable driving roll means on said front end of said support, and a manually operated drive actuator separate from said means for supporting said drum in one hand, said actuator being pivotally mounted by the one hand to radially displace said cable against said driving roll means while the one hand supports the drum and the other hand rotates the drum, said means for supporting said drum in one hand includes a portion of said support extending axially between said front and rear ends and having an outer surface generally parallel to said drum axis, said portion of the support being arcuate in cross section transverse to said drum axis and opening radially inwardly relative thereto, said drive actuator including an actuator arm mounted on said front end of said support for pivotal displacement about an arm axis transverse to said drum axis, and an actuator roll mounted on said arm forwardly of said arm axis for rotation about an actuator roll axis, said driving roll means including a pair of driving rolls mounted on said front end of said support forwardly of said arm axis for rotation about a corresponding driving roll axis, and said arm extending axially from said arm axis toward said rear end of said support and being pivotal toward said drum axis and said portion of the support for said actuator roll to displace said cable against said driving rolls.

36. A drain cleaning tool according to claim 35, wherein said driving roll and said pair of actuator rolls are equally spaced apart about said drum axis and wherein each of said driving roll axes and said actuator roll axis is skewed relative to said drum axis.

37. A drain cleaning tool according to claim 36, wherein said actuator arm is arcuate in cross section transverse to said drum axis and opens radially inwardly relative thereto, said portion of said support and said actuator arm providing a passage between said front and rear ends of said support.

38. A drain cleaning tool according to claim 37, wherein said portion of said support and said front and rear ends of said support include means cooperatively providing a drum support passageway between said front and rear ends, said drum having axially spaced front and rear walls, an opening through said front wall coaxial with said drum axis and a drum support tube coaxial with said opening and extending forwardly of said front wall and through said drum support passageway, said passageway interengaging with said tube to rotatably support said drum, said end of the cable extending through said opening and said tube, and said crank arm being on said rear wall of said drum.

* * * * *

UNITED STATES PATENT AND TRADEMARK OFFICE

CERTIFICATE OF CORRECTION

PATENT NO. : 6,158,076
DATED : December 12, 2000
INVENTOR(S) : Rutkowski et al.

It is certified that error appears in the above-identified patent and that said Letters Patent is hereby corrected as shown below:

Column 1,
Line 33, change "to" to -- into --;
Line 60, change "dram" to -- drum --.

Column 5,
Line 50, change "operative" to -- inoperative --.

Column 9,
Line 62, change "mounted" to -- moved --.

Column 10,
Line 35, change "roll" to -- rolls --;
Line 52, change "mounted" to -- moved --.

Column 11,
Line 12, change "mounted" to -- moved --;
Line 34, change "roll" to -- rolls --.

Column 12,
Line 5, change "mounted" to -- moved --;
Line 39, change "driving" to -- actuator --; and change "actuator" to -- driving --;
Line 45, change "driving" to -- actuator --, and change "actuator" to -- driving --; and
Line 62, change "mounted" to -- moved --.

Column 13,
Line 17, change "driving" to -- actuator --, and change "actuator" to -- driving --.

Signed and Sealed this

Ninth Day of April, 2002

*Attest:*

*Attesting Officer*

JAMES E. ROGAN
*Director of the United States Patent and Trademark Office*